US006116715A

United States Patent [19]

Lefebvre et al.

[11] Patent Number: 6,116,715

[45] Date of Patent: Sep. 12, 2000

[54] DEVICE AND METHOD FOR SENSING LOW INK LEVEL IN AN INK CARTRIDGE OF A POSTAGE METER

[75] Inventors: William T. Lefebvre, Rocky Hill; Charles F. Murphy, III, Milford, both of Conn.

[73] Assignee: Pitney Bowes Inc., Stamford, Conn.

[21] Appl. No.: 08/701,897

[22] Filed: Aug. 23, 1996

[51] Int. Cl.[7] ..... B41J 29/393

[52] U.S. Cl. ..... 347/19

[58] Field of Search ..... 347/19, 7, 2, 4, 347/23; 428/316.6; 364/464.02, 515

[56] References Cited

U.S. PATENT DOCUMENTS

| | | | |
|---|---|---|---|
| 4,202,267 | 5/1980 | Heinzl et al. . | |
| 5,068,806 | 11/1991 | Gatten | 347/19 |
| 5,132,711 | 7/1992 | Shinada et al. . | |
| 5,172,140 | 12/1992 | Hirabayashi et al. | 347/23 |
| 5,365,312 | 11/1994 | Hillmann et al. . | |
| 5,414,452 | 5/1995 | Accatino et al. . | |
| 5,467,709 | 11/1995 | Salomon . | |
| 5,513,563 | 5/1996 | Berson | 347/4 |
| 5,515,087 | 5/1996 | Lim et al. | 347/19 |
| 5,635,961 | 6/1997 | Sato | 347/7 |

FOREIGN PATENT DOCUMENTS

| | | | |
|---|---|---|---|
| 0 714 776 | 5/1996 | European Pat. Off. | 347/23 |
| 0714776 A2 | 6/1996 | European Pat. Off. . | |
| 359194853 | 11/1984 | Japan | 347/7 |
| 62-092850 | 4/1987 | Japan . | |
| 2272789 | 5/1994 | United Kingdom . | |
| WO 92/18335 | 10/1992 | WIPO . | |

*Primary Examiner*—John Barlow
*Assistant Examiner*—Charles W. Stewart, Jr.
*Attorney, Agent, or Firm*—Steven J. Shapiro; Michael E. Melton

[57] ABSTRACT

An ink sensing apparatus for a value dispensing device having a printhead which prints an indication of value includes a device for determining a total amount of ink consumed by the value dispensing device based on a total number of indications of value printed by the printhead and a total number of maintenance actions performed on the printhead; a device for ascertaining that the total amount of ink consumed by the value dispensing device has exceeded a predetermined amount; and a device for providing an indication that the total amount of ink consumed by the value dispensing apparatus has exceeded the predetermined amount. A method associated with the above device includes the steps of: determining a total amount of ink consumed by the value dispensing device based on a total number of indications of value printed by the printhead and a total number of maintenance actions performed on the printhead; ascertaining that the total amount of ink consumed by the value dispensing device has exceeded a predetermined amount; and providing an indication that the total amount of ink consumed by the value dispensing apparatus has exceeded the predetermined amount.

13 Claims, 4 Drawing Sheets

FIG. 3

| POSTAGE METER MAINTENANCE EVENT | POSSIBLE MAINTENANCE ACTIONS REQUIRED |
|---|---|
| MAINTENANCE AT POWER UP WITH BACK-UP BATTERIES INSTALLED | IF AT POWER UP THE PRINTHEAD IS CAPPED DEPENDING ON THE TIME ELAPSED SINCE THE LAST PURGING ACTION THE METER WILL EITHER PERFORM NO MAINTENANCE, A NORMAL PURGE, OR A POWER PURGE. IF UNCAPPED, THE METER WILL ENTER A ROUTINE THAT RESULTS IN NO MAINTENANCE ACTION OR A NORMAL PURGE OR A POWER PURGE DEPENDING ON THE TIME ELAPSED SINCE THE POWER WAS OFF |
| MAINTENANCE AT POWER UP WITH NO BACK-UP BATTERIES INSTALLED | IF PRINTHEAD IS CAPPED AT LEAST A TEST PRINT IS PERFORMED AND POSSIBLY A POWER PURGE DEPENDING ON THE TEST PRINT. IF UNCAPPED THE SAME POSSIBILITIES EXIST AS FOR THE INSTALLED BATTERY CONDITION |
| MAINTENANCE PRIOR TO PRINTING | DEPENDING ON THE TIME ELAPSED SINCE THE LAST FLUSH AND THE AMBIENT TEMPERATURE EITHER NO MAINTENANCE ACTION IS PERFORMED OR A NORMAL FLUSH, POWER FLUSH, OR A PLURALITY OF TYPES OF FLUSHES ARE PERFORMED |
| AFTER PRINTING AND WHEN PRINTHEAD IS CAPPED | DEPENDING UPON THE TIME ELAPSED SINCE THE LAST PRINT AND THE NUMBER OF TIMES THE PRINTHEAD HAS BEEN MOVED TO THE CAPPING POSITION, EITHER NO MAINTENANCE ACTION OCCURS OR A NORMAL PURGE IS PERFORMED |
| AUTOMATIC MIDNIGHT MAINTENANCE | THIS IS AN AUTOMATIC DAILY ROUTINE WHICH DEPENDING ON THE TIME SINCE A LAST PURGE AND THE CAPPED OR UNCAPPED POSITION OF THE PRINTHEAD, EITHER NO MAINTENANCE ACTION OCCURS OR A NORMAL PURGE OR A POWER PURGE MAY OCCUR |
| AUTOMATIC FLUSH INTO CAP | AT 12 HOURS AFTER LAST FLUSH, DEPENDING ON WHETHER PRINT-HEAD IS CAPPED OR UNCAPPED, A NORMAL FLUSH IS PERFORMED |
| MAINTENANCE AT WAKE-UP | DEPENDING UPON WHETHER THE PRINTHEAD WAS CAPPED OR UNCAPPED EITHER NO MAINTENANCE IS PERFORMED OR A NORMAL OR POWER PURGE IS PERFORMED |
| USER INDUCED MAINTENANCE | USER CAN PERFORM A NORMAL PURGE OR UPON INSTALLATION OF A NEW PRINTHEAD THE METER AUTOMATICALLY PERFORMS AN INITIAL LOAD PURGE, OR UPON INSTALLATION OF A NEW INK CARTRIDGE THE METER AUTOMATICALLY PERFORMS A POWER PURGE |

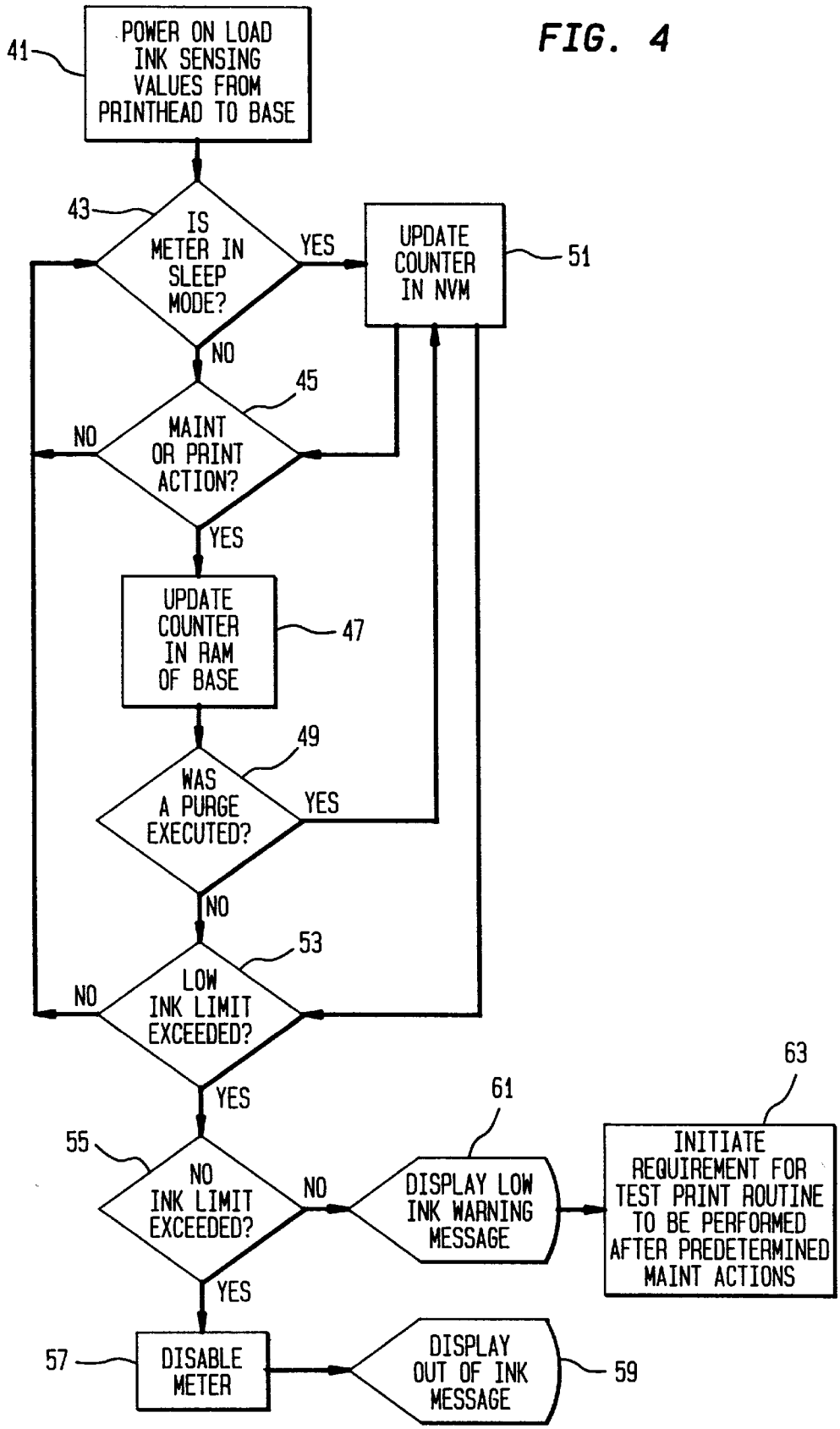
FIG. 4
41
POWER ON LOAD INK SENSING VALUES FROM PRINTHEAD TO BASE
43
IS METER IN SLEEP MODE?
YES
UPDATE COUNTER IN NVM
51
NO
45
MAINT OR PRINT ACTION?
NO
YES
UPDATE COUNTER IN RAM OF BASE
47
49
WAS A PURGE EXECUTED?
YES
NO
53
LOW INK LIMIT EXCEEDED?
NO
YES
55
NO INK LIMIT EXCEEDED?
NO
61
DISPLAY LOW INK WARNING MESSAGE
63
INITIATE REQUIREMENT FOR TEST PRINT ROUTINE TO BE PERFORMED AFTER PREDETERMINED MAINT ACTIONS
YES
57
DISABLE METER
DISPLAY OUT OF INK MESSAGE
59

DEVICE AND METHOD FOR SENSING LOW INK LEVEL IN AN INK CARTRIDGE OF A POSTAGE METER

BACKGROUND

This invention is relates to a method and apparatus for determining when the ink supply within an ink cartridge is low, and more particularly relates to a method and apparatus for determining when an ink cartridge used in a postage meter should be replaced.

Digital printing apparatus utilizing known ink jet printing techniques typically have a source of supply ink which is used by a printhead for printing on a recording medium. Replacement or replenishment of the ink supply is periodically required in order to ensure that continued satisfactory printing occurs. Previously, the determination as to when the ink supply should be replaced or replenished was usually made by the operator when the images being printed began to appear light or spotty. This simple visual procedure proved quite satisfactory in a majority of applications such as typewriters, word processors, and computer printers, because if a document of unsatisfactory print quality was produced, the ink supply could be replenished or changed and the document reprinted with little impact to the user. However, in printing devices used, for example, in connection with scientific equipment or in facsimile machines, the failure by the printing device to produce a readable image and the corresponding loss of data associated therewith could present a significant problem for the user.

U.S. Pat. No. 5,068,806 addresses the problem associated with printing devices where the loss of image data is unacceptable. This patent describes an apparatus which counts every individual ink dot that is ejected by the printhead in printing the image data. The apparatus keeps a running total of the number of ink dots ejected by the printhead during printing and continuously compares this total to a predetermined number of ink dots. In the event that the running total exceeds the predetermined number, a message is provided to the operator advising that the ink supply is low and should be replaced.

Additionally, it is known from U.S. Pat. No. 4,202,267 and 5,131,711 to utilize either optical sensors or conductive electrodes in an ink supply structure. Each of these devices determines the amount of ink remaining in the ink supply structure and provides an indication when the ink level reaches a predetermined low level such that the ink supply can be replaced.

Each of the above solutions for determining when to replace an ink supply, such as a commonly used disposable ink cartridge in ink jet printers, has serious limitations if applied to a device such as a postage meter. That is, a postage meter prints a postage indicia on a mailpiece as evidence that postage has been paid. Typically, the postage is accounted for in the meter prior to printing of the indicia. Therefore, in the event that an illegible indicia is printed, the postage meter user has been charged for an indicia that was not used. Accordingly, the method of visually determining when to replace the ink cartridge is unacceptable for postal applications.

With regard to the use of conductive electrodes and optical sensors, they are an expensive solution for determining when to replace an ink cartridge. Thus, in the small office/home office (SOHO) business environment where postage utilization is not high volume and a low cost postage meter is desired, these solutions are not practical.

As for the solution of counting the actual number of ink dots fired by the printhead during the printing of image data as a means of determining when to replace an ink cartridge, it is also inadequate in the postage meter environment. That is, it is inherent in the structure described in U.S. Pat. No. 5,068,806 that the volume of ink consumed in printing is significantly greater than the volume of ink consumed during routine printhead maintenance functions so that the ink used during the performance of maintenance functions is considered to be at noise level and is not accounted for in determining when to replace the ink supply. This would typically be the case in many printing devices where continuous large quantities of variable images are being printed on a regular basis such as in a computer printer or a word processor. In this situation, since extensive amounts of printing are being done on a regular basis, the printhead nozzles tend to remain unclogged due to the heavy printing activity itself. Thus, the known periodic maintenance actions of flushing and purging the printhead to ensure that the printhead nozzles do not become permanently blocked by debris or dried ink are not frequently required, and the ink used during such actions can be ignored in the ink dot count. A postage meter however, presents a very different printing environment particularly in the SOHO business arena where a user may only utilize the postage meter on a very infrequent basis. In this scenario, where the amount of actual printing over extended periods of time can be very small, it is necessary that much more extensive and frequent automatic maintenance actions be performed on the postage meter printhead, as compared to the high print volume applications discussed above, in order to ensure that the printhead nozzles are not clogged when called upon to print the indicia image. Moreover, since the indicia image is substantially a fixed image of a predetermined size, the total number of ink dots required to produce the image is significantly less than most general purpose printer applications where pages of material are being printed. Therefore, even in an environment where the meter is used regularly, the need for more frequent printhead maintenance actions is still required for the postage meter as compared to most printing applications. Accordingly, if a postage meter simply counted the ink dots deposited during printing of the indicia as the method for determining when to replace the ink cartridge, the cartridge would run out of ink well before a warning was given to the operator because the extensive amount of ink utilized in performing the required maintenance actions would not be accounted for.

SUMMARY OF THE INVENTION

It is the object of the invention to provide an effective ink sensing device for use in a value dispensing mechanism. This object is met by an ink sensing apparatus for a value dispensing device having a printhead which prints an indication of value, the ink sensing apparatus including a device for determining a total amount of ink consumed by the value dispensing device based on a total number of indications of value printed by the printhead and a total number of maintenance actions performed on the printhead; a device for ascertaining that the total amount of ink consumed by the value dispensing device has exceeded a predetermined amount; and a device for providing an indication that the total amount of ink consumed by the value dispensing apparatus has exceeded the predetermined amount.

A further object is to provide a method associated with the above device. This object is met by a method for indicating ink supply status in a value dispensing device having a printhead which prints an indication of value, the method including the steps of: determining a total amount of ink consumed by the value dispensing device based on a total number of indications of value printed by the printhead and a total number of maintenance actions performed on the printhead; ascertaining that the total amount of ink consumed by the value dispensing device has exceeded a predetermined amount; and providing an indication that the total amount of ink consumed by the value dispensing apparatus has exceeded the predetermined amount.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 3 is a chart showing maintenance actions in the inventive postage meter;

FIG. 4 is a flow chart of the ink sensing program in the postage meter;

DETAILED DESCRIPTION OF THE PREFERRED EMBODIMENTS

Figure 1:
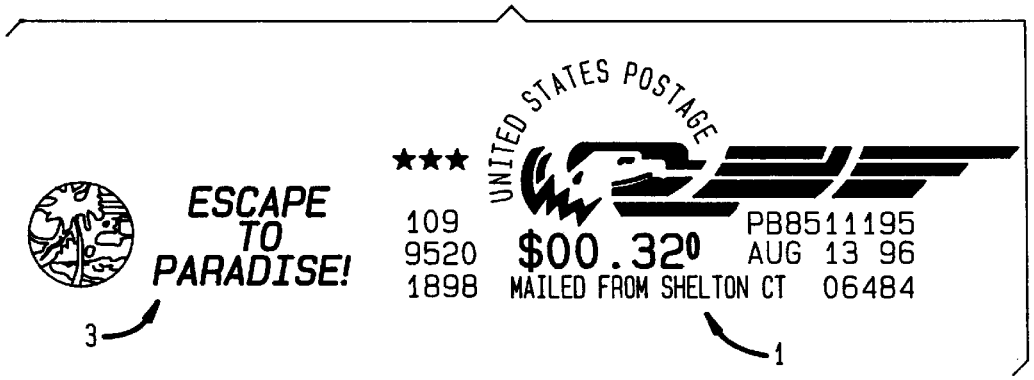
FIG. 1 shows an indicia printed by the inventive postage meter.

Referring to FIG. 1, there is shown a postage indicia 1 which is typical of those printed by known postage meters utilizing a digital printhead. The to indicia 1 is substantially a fixed image except that certain data such as the postage value and the date are variable data which can change with each postage transaction. Additionally, immediately adjacent to the indicia 1 is an advertising slogan 3 which can be tailored to a particular meter user for their own business purposes. For the purpose of simplicity in this application, the term "indicia image" is utilized to encompass either an indicia 1 printed alone or an indicia 1 printed together with an advertising slogan 3. The indicia 1 and advertising slogan 3 jointly are contained within a readily defined space of approximately 1 by 4.5 inches. Accordingly, the total number of ink dots required to create the indicia image is substantially fixed such that the total ink dot variation between different postage transactions will only depend upon the variable data differences. Moreover, and as will be discussed in more detail below, the amount of ink consumed in producing the indicia image is significantly less than that consumed by the printhead maintenance functions such that the variations between indicia image ink drop counts can be ignored as being at noise level. Thus, in the inventive apparatus, a fixed ink dot count is associated with the printing of any indicia image. In the preferred embodiment this fixed ink dot count is based on an average ink dot count of the many indicia images that can be produced for different countries around the world.

Regarding the maintenance actions required to ensure that the postage meter nozzles remain unclogged, the two commonly known actions are flushing and purging. In a flushing maintenance action the printhead nozzles are fired a predetermined number of times into a spittoon or a maintenance cap to clear any clogged nozzles. In purging, a vacuum is applied to a maintenance cap which hermetically seals the printhead nozzles. The vacuum causes ink to be drawn through the nozzles from the ink supply and into a waste reservoir. Both the flushing and purging actions are well known in the art such that a further detailed description is not considered warranted for the purpose of understanding the instant invention. The amount of ink consumed by the postage meter in printing an indicia image as compared to the amount of ink consumed for by various maintenance actions required for the printhead is set forth in the Table 1 below.

| ACTION | SOFTWARE COUNT | MILLILITERS OF INK CONSUMED |
|---|---|---|
| Print indicia and Advertising slogan | 3 | 0.001485 |
| Normal Flush | 1 | 0.000205 |
| Power Flush | 8 | 0.00164 |
| Power purge | 6,926 | 1.42 |
| Normal Purge | 1,609 | 0.33 |
| Initial Load | 11,819 | 2.42 |
| Low ink limit | 51,219 | 10.5 |
| No ink limit | 97,560 | 20 |

As the Table shows, all of the ink consumption values have been normalized as a software count relative to the normal flush maintenance count which itself has been given a software count of 1. Thus, for example, when a power purge is performed, 3,220 times as much ink is consumed as compared to that consumed for a normal flush and 1,073 times as much ink is consumed as compared to that consumed in printing an indicia/advertising slogan. The above software counts are used as described in more detail below in a software routine to determine both a low ink condition and an out of ink condition.

The enumerated ink consumption differences between similar maintenance actions is simply a matter of the number of times a specific action is done. For example, in a normal flush if a printhead having 64 nozzles which each produce an ink drop size of 50 picoliters is used, all of the nozzles are fired 64 times. However, if the power flush routine is exercised, each nozzle is fired 512 times. Similarly, during the operation of a priming pump, a normal purge extracts 0.33 ml of ink and a power purge simply is approximately four normal purges done sequentially to extract 1.42 ml of ink. The initial load is a one time special purge of the printhead when a meter is first received or when a new printhead is installed. The special purge extracts a preservation transport fluid which is contained in the printhead for shipping purposes and at the same time extracts a predetermined amount of ink. The low ink limit and the no ink limit identify threshold ink consumption values which when exceeded will respectively trigger the postage meter to display "low" and "out of ink" messages to the meter operator.

Figure 2:
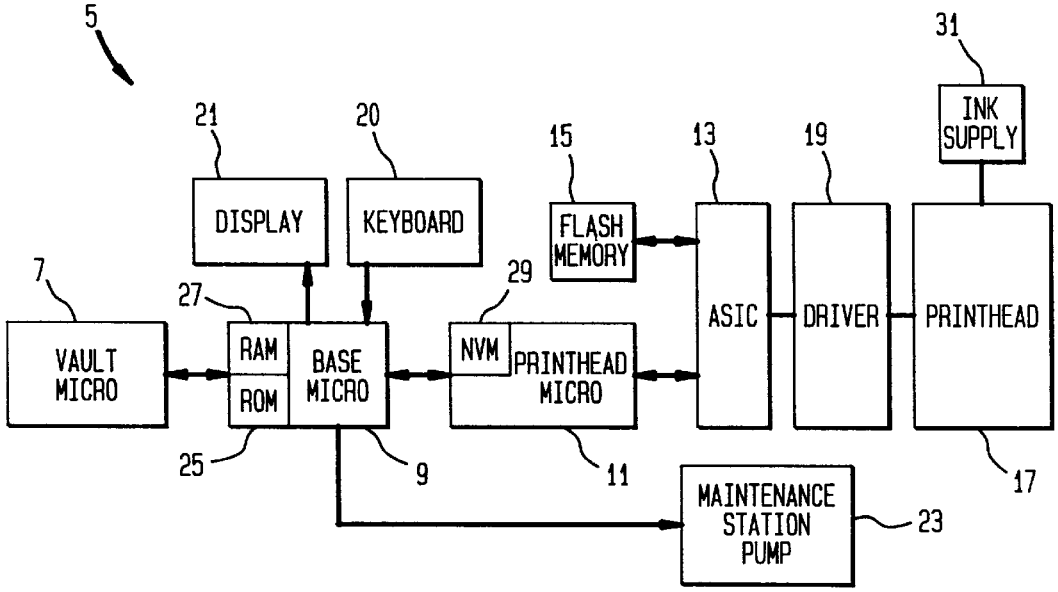
FIG. 2 is an electrical block diagram of the inventive postage meter.

FIG. 2 shows the basic schematic electrical block diagram of a postage meter 5 incorporating the instant invention. Postage meter 5 includes a vault microprocessor 7, a base microprocessor 9 and a printhead microprocessor 11. Vault microprocessor 7 performs funds accounting for the postage transactions while printhead microprocessor 11, in conjunction with ASIC 13 and Flash memory 15, initiate printing by ink jet printhead 17 via driver 19. Vault microprocessor 7 and printhead microprocessor 11 also perform a mutual authentication handshake prior to each postage transaction to ensure they are both authorized equipment. Base microprocessor 9 acts as a communication channel between vault microprocessor 7 and printed microprocessors 11, and also serves as a traffic cop in receiving user input from a keyboard 20 and relaying information to the operator via a display 21. More importantly, for the purposes if the instant invention, base microprocessor 9 activates the maintenance station pump 23 to perform the required purges of printhead 17 and initiates the flushing maintenance actions of printhead 19 via the printhead microprocessor 11 and the ASIC 13, all in accordance with maintenance routines that are stored in the base microprocessor ROM 25. ROM 25 also stores the ink sensing program discussed in more detail below. Base microprocessor 9 also includes a working memory 27 (RAM), while printhead microprocessor 11 includes a nonvolatile memory 29, which in the preferred embodiment is a EEPROM. Furthermore, for the sake of completeness, an ink supply cartridge is shown at 31 and is mechanically releasably coupled to printhead 17 in a known manner. A more detailed discussion of the electronic architecture of postage meter 5 is described in copending U.S. patent application Ser. No. 08/554,179 which was filed on Nov. 6, 1995, which is incorporated herein by reference.

A summary of the maintenance routines that are stored in ROM 25 are shown in FIG. 3. Since the specific maintenance routines are not part of the instant invention, only a summary of the routines is presented to provide an appreciation for the complexity of the required maintenance operations and the frequency of their execution depending upon meter conditions (power on/off, printhead capped/uncapped), time elapsed after last purge or last flush or last print or straight time elapsed. As FIG. 3 clearly shows, the maintenance actions performed occur on a regular basis regardless of whether the meter is actually used for printing. All of the postage meter maintenance events except for the user induced events, are automatically executed by the maintenance routines stored in ROM 25. Accordingly, as previously discussed, due to the low usage of postage meter 5 for printing indicia images and the low amount of ink dots required to print the substantially fixed indicia image, a substantial amount of ink in the postage meter will be consumed by the regularly occurring maintenance activities. Moreover, as use of the meter for printing indicia images decreases the amount of ink consumed in maintenance as compared to printing increases.

Figure 5:
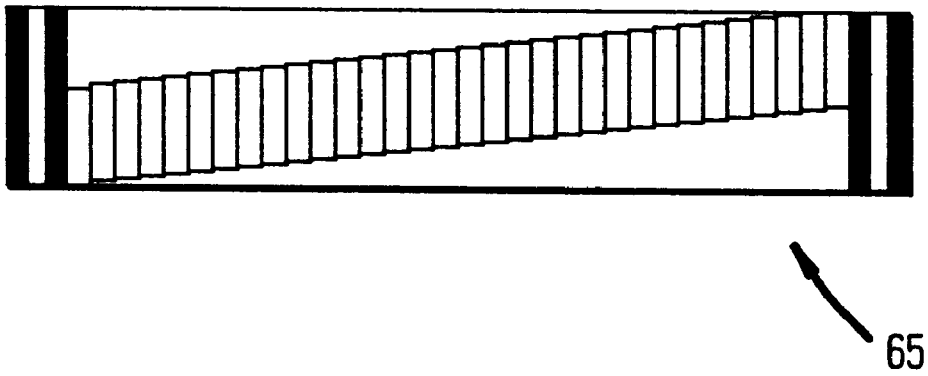
FIG. 5 shows a good print test pattern; and after newly added line 15 add the following new line.
Figure 6:
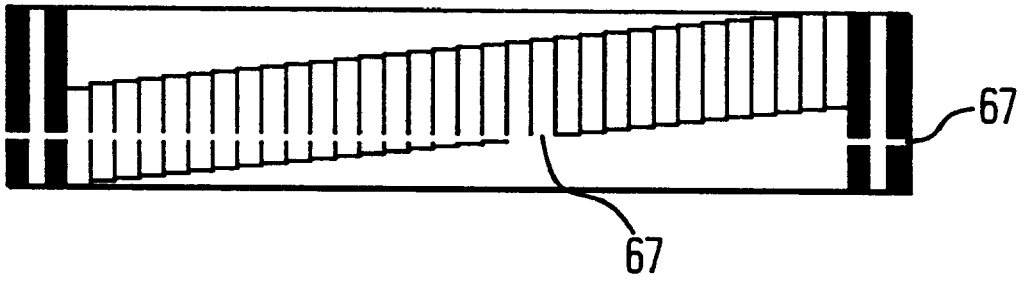
FIG. 6 shows a bad print test pattern.

With reference to FIGS. 2 and 4, the inventive ink sensing apparatus and its operation will be described. Prior to the first use of postage meter 5, flash memory 15 has stored therein the weighting factors (software counts) for each maintenance action shown in Table 1, as well as the software count threshold values for the "low ink limit" and the "no ink limit". Upon installation of the meter for customer use, ASIC 13 downloads each of the above-mentioned counts into NVM 29. NVM 29 also has a counter therein which is updated periodically as discussed below to keep a combined running total of software counts for each maintenance and print action which occurs. When postage meter 5 is placed in a power on condition, the ink sensing program in ROM 25 (FIG. 4) reads the combined counter value and all of the individual software counts stored in NVM 29 into RAM 27, as shown in step 41. At step 43, a determination is made as to whether postage meter 5 has entered a "sleep mode" to conserve energy. Putting an electronic device into a sleep mode is well known in the art and in postage meter 5 it occurs if no printing has occurred for at least 10 minutes. If postage meter 5 is not in the sleep mode, the program moves to step 45 where it is determined if a maintenance or print action has occurred. If the answer is no, the program loops back to step 43. If however, a maintenance or print action has occurred, the total combined software counter register in RAM 29 is incremented by the count associated with the maintenance action(s) or print identified at step 47. The program, at step 49, then determines if a purge was executed and, if so, increments, at step 51, the total software count counter in NVM 29 by the software counts associated with the specific purging action. In the event a purge was not executed or after step 51, the program proceeds to step 53 and compares the total software count in the counter of RAM 27 with the low ink limit threshold value stored in RAM 27. If the low ink limit threshold value is not exceeded, the program returns to step 43. If however, the low ink limit threshold value is exceeded, the program proceeds to step 55 where it is determined if the total software count in RAM 27 exceeds the no ink limit threshold value. If it does, at step 57 the meter is disabled from performing all printing and maintenance actions and at step 59 display 21 shows an "out of ink" message which lets the operator know that the ink cartridge must be replaced. On the other hand, at step 55, if the no ink limit threshold value is not exceeded, then at step 61 display 21 shows a message indicating that the ink supply level is low. Further, at step 63, the program will initiate a requirement for the operator to perform a test print routine after each automatic midnight maintenance routine and after 50 printhead cappings. The test print routine requires the user to print a test pattern 65 shown in FIG. 5 which is selected via keyboard 20. If test pattern 65 has blank lines 67 in it as shown in FIG. 6, the operator will select to have a second test pattern printed and postage meter 5 will first perform a normal flush prior to printing the next test pattern. The operator can keep printing test patterns in an attempt to solve the print problem or can decide to replace the ink supply cartridge. In yet another embodiment, the test print process can be attempted three times, and if a good test pattern is not produced after the third try, the operator will be prompted to replace the ink supply cartridge 31.

Returning to step 43, if the answer to the inquiry is yes, the total ink dot counter in NVM 29 is updated with the total ink software counter value stored in RAM 27. Therefore, the counter in NVM 29 is only updated after any purge action or when the meter enters the sleep mode. This feature was added because the EEPROM used as NVM 29 has a finite number of times it can be written to. Accordingly, it was not desirable to update the counter in NVM 29 after every individual maintenance and print action.

Additional advantages and modifications will readily occur to those skilled in the art. Therefore, the invention in its broader aspects is not limited to the specific details, and representative devices, shown and described herein. For example, while a postage meter has been described in the preferred embodiment, any type of value dispensing mechanism, such as, tax stamp machines, lottery machines, etc., could incorporate the invention. Moreover, the invention could include a further software routine to reset the counter when a new ink supply (cartridge) is replaced. Furthermore, the term "no ink" would include an extremely low ink condition but prior to the ink actually running out. Accordingly, various modifications may be made without departing from the spirit or scope of the general inventive concept as defined by the appended claims.

What is claimed is:

1. An ink sensing apparatus for a value dispensing device having a printhead which has maintenance actions performed thereon and which prints an indication of value, the printed indication of value being associated with a predetermined fixed amount of ink consumed by the value dispensing device during printing of a single one of the indication of value, the ink sensing apparatus comprising:

means for determining a total amount of ink consumed by the value dispensing device based on a total number of indications of value printed by the printhead, the predetermined fixed amount of ink consumed, and a total number of maintenance actions performed on the printhead and for ascertaining that the total amount of ink consumed by the value dispensing device has exceeded a predetermined amount; and means for providing an indication that the total amount of ink consumed by the value dispensing apparatus has exceeded the predetermined amount.

2. An ink sensing apparatus as recited in claim 1 wherein the maintenance actions include a plurality of maintenance actions which are distinct from each other and the determining and ascertaining means includes means for storing a corresponding software count for each of the plurality of maintenance actions and for each printing of the indication of value, each of the corresponding software counts being normalized relative to each other with respect to an amount of ink consumed during each of the plurality of maintenance actions and the predetermined fixed amount of ink consumed during printing of the single one of the indication of value, wherein the determining and ascertaining means further includes a first counter which is incremented by the corresponding software count each time the indication of value is printed and each time any of the plurality of maintenance actions is performed so that the first counter identifies a running combined total software count which corresponds to the total amount of ink consumed by the printhead for all printings of the indication of value and the plurality of maintenance actions performed.

3. An ink sensing apparatus as recited in claim 2, wherein the predetermined amount is an amount indicative of a predetermined low ink level.

4. An ink sensing apparatus as recited in claim 3, wherein at times when the determining and ascertaining means has ascertained that the predetermined low ink level has been exceeded the determining and ascertaining means then ascertains if a predetermined no ink level has been exceeded and if the predetermined low ink level has been exceeded while the predetermined no ink level has not been exceeded the indication is a message which is displayed indicating a low ink level.

5. An ink sensing apparatus as recited in claim 4, wherein the plurality of maintenance actions includes at least one time driven automatic maintenance action performed on the printhead, and further comprising means for requiring the value dispensing mechanism to perform a test print after the time driven automatic maintenance action is performed at times when the message is displayed.

6. An ink sensing apparatus as recited in claim 2, further comprising a second counter which is overwritten with contents of the first counter only upon occurrence of a specified event.

7. An ink sensing apparatus as recited in claim 6, wherein the specified event is one of a purging maintenance action performed on the value dispensing device and the value dispensing device entering a sleep mode.

8. A method for indicating ink supply status in a value dispensing device having a printhead which prints an indication of value, the method comprising the steps of:

performing maintenance actions on the printhead;

printing the indication of value on a recurring basis;

storing an indication of value software count which is indicative of an assumed predetermined fixed amount of ink consumed by the value;

dispensing device during printing of any single one of the indication of values determining a total amount of ink consumed by the value dispensing device based on a total number of indications of value printed by the printhead, the stored indication of value software count, and a total number of maintenance actions performed on the printhead;

ascertaining that the total amount of ink consumed by the value dispensing device has exceeded a predetermined amount; and providing an indication that the total amount of ink consumed by the value dispensing apparatus has exceeded the predetermined amount.

9. A method as recited in claim 8 wherein the maintenance actions include a plurality of maintenance actions which are distinct from each other and further comprising storing a corresponding maintenance software count for each of the plurality of maintenance actions, normalizing each of the corresponding maintenance software counts relative to each other with respect to an amount of ink consumed during each of the plurality of maintenance actions and the assumed predetermined fixed amount of ink consumed during printing of any single one of the indication of value, incrementing a counter by the indication of value software count each time the indication of value is printed and by the corresponding maintenance software count each time any of the plurality of maintenance actions is performed so that the counter identifies a running combined total software count which corresponds to the total amount of ink consumed by the printhead for all the printings of the indication of value and the plurality of maintenance actions performed.

10. A postage meter comprising:

a printhead for printing a plurality of indicia images which each consume a different amount of ink during printing;

means for storing a single value indicative of a predetermined fixed amount of ink assumed to be consumed during printing of any single one of the plurality of indicia images;

means for performing maintenance actions on the printhead;

means for determining a total amount of ink consumed by the postage meter based on a total number of the plurality of indicia images printed by the printhead, the single value of the predetermined fixed amount of ink assumed to be consumed during printing of any single one of the plurality of indicia images, and a total number of maintenance actions performed on the printhead and for ascertaining that the total amount of ink consumed by the postage meter has exceeded a predetermined amount; and means for providing an indication that the total amount of ink consumed by the postage meter has exceeded the predetermined amount.

11. A printing apparatus comprising:

a printhead for printing a substantially fixed image on a recurring basis, the printed substantially fixed image being associated with a predetermined fixed amount of ink consumed by the printhead during printing of a single one of the substantially fixed image;

means for performing maintenance actions on the printhead;

means for determining a total amount of ink consumed by the printhead based on a total number of substantially fixed images printed by the printhead, the predetermined fixed amount of ink consumed, and a total number of maintenance actions performed on the printhead by the means for performing maintenance actions.

12. A printing apparatus as recited in claim 11, wherein the printhead is an ink jet printhead.

13. An ink sensing apparatus as recited in claim 7, further comprising a random access memory and a non-volatile memory and wherein the first counter is in the random access memory and the second counter is in the non-volatile memory.

* * * * *